US005452890A

United States Patent [19]

Bingman

[11] Patent Number: 5,452,890

[45] Date of Patent: Sep. 26, 1995

[54] GOLF CLUB HEAD HAVING PROTECTING INSERT

[76] Inventor: George Bingman, 957 Raymond Ave., Barberton, Ohio 44203

[21] Appl. No.: 207,304

[22] Filed: Mar. 7, 1994

[51] Int. Cl.[6] ..... A63B 53/02

[52] U.S. Cl. ..... 273/80.2; 273/80.4; 273/167 H

[58] Field of Search ..... 273/80.1, 80.2, 273/80.3, 80.4, 80.5, 80.6, 80.7, 80.8, 80.9, 167 K, 167 H

[56] References Cited

U.S. PATENT DOCUMENTS

| | | | |
|---|---|---|---|
| D. 93,862 | 11/1934 | Barnhart . | |
| D. 216,030 | 11/1969 | Wigley . | |
| D. 318,087 | 7/1991 | Helmstetter . | |
| 581,331 | 4/1897 | Brewster . | |
| 645,944 | 3/1900 | Dalgleish . | |
| 1,202,383 | 10/1916 | Hardman | 273/167 K |
| 1,444,842 | 2/1923 | Lagerblade | 273/80.5 |
| 1,551,563 | 9/1925 | Heller | 273/80.4 |
| 1,868,286 | 4/1930 | Grieve . | |
| 1,882,509 | 10/1932 | Lagerblade | 273/80.5 |
| 1,983,069 | 12/1934 | Cowdery | 273/80.3 |
| 2,020,048 | 11/1935 | Cook | 273/80.7 |
| 3,572,709 | 3/1971 | Risher | 273/80.2 |
| 3,810,621 | 5/1974 | Mills . | |
| 4,214,754 | 7/1980 | Zebelean . | |
| 4,429,879 | 2/1984 | Schmidt . | |
| 4,438,931 | 3/1984 | Motomiya | 273/80.2 |
| 4,948,132 | 8/1990 | Wharton | 273/80.1 |
| 5,042,806 | 8/1991 | Helmstetter . | |
| 5,280,923 | 1/1994 | Lu | 273/80.2 |
| 5,335,909 | 8/1994 | Green | 273/80.4 |

FOREIGN PATENT DOCUMENTS

| | | | |
|---|---|---|---|
| 763652 | 4/1934 | France | 273/80.4 |
| 314978 | 7/1930 | United Kingdom | 273/80.4 |
| 398721 | 9/1933 | United Kingdom | 273/80.1 |
| 2225959 | 6/1990 | United Kingdom | 273/80.7 |
| 2241173 | 8/1991 | United Kingdom | 273/80.2 |
| 8704634 | 8/1987 | WIPO | 273/80.2 |
| 9000424 | 1/1990 | WIPO | 273/80.1 |

OTHER PUBLICATIONS

Samples of Calloway–Brand O–Ring.

*Primary Examiner*—Sebastiano Passaniti
*Attorney, Agent, or Firm*—Oldham, Oldham & Wilson Co.

[57] ABSTRACT

Golf club of the metal wood type and club head therefor. The golf club comprises a metallic club head having a shaft-receiving bore, and a metallic shaft which is inserted into the bore. An insert, which is less hard than the shaft, is inserted into the upper end of the bore for cushioning the shaft from fracture. A shoulder is formed in the bore for positioning this insert. The shoulder may be formed by a counterbore or by a tubular sleeve which is inserted into the bore. The shaft extends through the insert and into the bore of the club head. The insert, which is positioned between the shaft and the wall of the bore or counterbore, cushions the shaft from stresses which tend to cause fracture of the shaft at the point at which it enters the club head.

19 Claims, 3 Drawing Sheets

GOLF CLUB HEAD HAVING PROTECTING INSERT

TECHNICAL FIELD

The present invention relates to golf clubs and more particularly to a metal wood golf club having an improved structure for attachment of the shaft to the head of the club.

BACKGROUND ART

Golf is a game that is played and enjoyed by millions of people around the world. It is therefore understandable that much attention has been given over the years to improving the equipment that is used to play the game. Improvements in playing equipment have resulted in better scores for many people and equipment that is more serviceable and less prone to damage or absolute failure, all of which have led to an increased enjoyment of the game.

A notable development in the art of golf clubs was the introduction of the metal driver, or "metal wood" as disclosed in U.S. Pat. No. 4,214,754. As shown therein, a head for a golf metal wood is in the form of a one piece hollow enclosed metal body which includes a heel and a toe, a face and a back, a sole and a topside, and a neck or hosel, which is integral with the club body and extends generally upwardly therefrom, for receiving a shaft. Other significant developments include the hosel-less wood golf club of U.S. Pat. No. 3,810,621 and the hosel-less metal wood of U.S. Pat. No. 5,042,806. Many other improvements have been made in golf clubs as illustrated by U.S. Pat. Nos. 581,331, 645,944, 1,868,286, 4,429,879, 4,438,931, Des. 93,862, Des. 216,030, and Des. 318,087.

In conventional practice a bore is provided in the club head of a metal wood and extends from an upper shalt-receiving opening in a hosel either to or toward the bottom surface or sole of the head. In the latter case, the bore may terminate in an end wall which is above the bottom surface or sole of the head. A hosel-less metal wood also has a bore which extends from an upper shaft receiving opening, which in that case is provided in the top surface of the club head body.

One problem that has been encountered in metal woods is stress fractures of the shaft. The shaft flexes slightly as a player swings a club. When the club head strikes a ball, the impact stresses the shaft at the upper end of the bore, which is at the upper end of a hosel in a conventional golf club and at the top surface of the club in a hosel-less golf club. The club becomes weakened at this point over time and eventually may fracture. This mode of failure is particularly a problem in a golf club in which the diameter of the bore is uniform over its entire length.

One approach to alleviate this problem has been to provide a tapered countersink in the bore just below upper opening in the hosel. The shaft is inserted into the club head through the hosel and fixedly attached therein with an adhesive. A rubber O-ring is placed at the interlace of the hosel and the shaft, thus hiding the glue joint and providing a neat, finished appearance. The O-ring is only for aesthetic purposes, and the adhesive holding it in place often breaks loose allowing the O-ring to slide up and down the shaft and requiring that it be glued back in place. Also, when the adhesive breaks loose, the shall is no longer cushioned at the intersection with the upper end of a hosel (or the top surface of a hosel-less golf club) so that stress which may ultimately lead to fracture is placed on the shall at this location.

As will become apparent in the disclosure which follows, the present invention provides an improvement over this convention practice.

DISCLOSURE OF THE INVENTION

The present invention provides a golf club and particularly a metal wood having a club head and a shaft, wherein club head has a shaft-receiving bore and wherein further a tubular insert is provided in the upper portion of the bore in order to prevent or minimize fracture of the shaft.

The present invention provides a club head for a golf club of the metal wood type, comprising:

an upper opening for insertion of a shaft;

a bore extending generally downwardly from said opening in a heel of said club, wherein the bore has an open upper end and means for providing a shoulder below the upper end; and an essentially cylindrical, tubular insert fitted within the bore, the insert having a first end and a second end, wherein the second end is seated in the shoulder.

The present invention according to another aspect provides a golf club of the metal wood type, comprising a club head as above described and a shaft that extends through the insert and into the bore in the club head.

The preferred structure for providing the shoulder is a counterbore. The counterbore is coaxial with the bore and just slightly larger in diameter. It extends downwardly from the upper shaft-receiving opening and forms a shoulder at its lower end for receiving and seating the second or lower end of the insert.

The insert is preferably made of a polymeric material which is strong and tough but less hard than the shaft, which is typically made of stainless steel. The insert protects the shaft from stress fracture at the intersection with the top surface of the club head or hosel, and is replaceable.

The insert has a lip around the circumference of one end, and when it is in place in the club assembly has substantially the same exterior visual effect as provided by the O-ring in prior art golf clubs.

The insert of this invention can be used in various golf club structures, including a club having a hosel as shown for example in the aforementioned U.S. Pat. No. 4,214,754 as well as in a hosel-less metal wood as shown in the aforementioned U.S. Pat. No. 5,042,806. The club head is typically in the form of a hollow metal shell as shown in both of these patents. The shell may be filled as shown in U.S. Pat. Nos. 4,438,931 and 5,042,806, both cited supra. The insert of this invention can also be used in a golf club head having a bore extending from an upper surface of either a hosel or the club head itself to the bottom surface or sole of the head, as well as in a club having a blind bore (i.e., a bore which terminates in an end wall inside the club head).

While the appearance of the clubs of the present invention is virtually identical to that of the earlier clubs, this invention eliminates the need for a taper at the top of the hosel. A very important aspect of the insert is that it provides a cushioning effect and thus eliminates damage to the shaft where it interfaces with the hosel. In other words, the sharp pressure contact point of the typical metal hosel, having just a slight taper as a stress point related to the shaft, will be spread over essentially the entire length of the cylindrical hosel insert, and yet give substantially the same visual effect that the O-ring provided in the past. An additional aspect of the use of the insert is the elimination of the O-ring as well as the nuisance factor of its breaking loose and sliding up and down the shaft.

DESCRIPTION OF THE PREFERRED EMBODIMENTS

Figure 1:
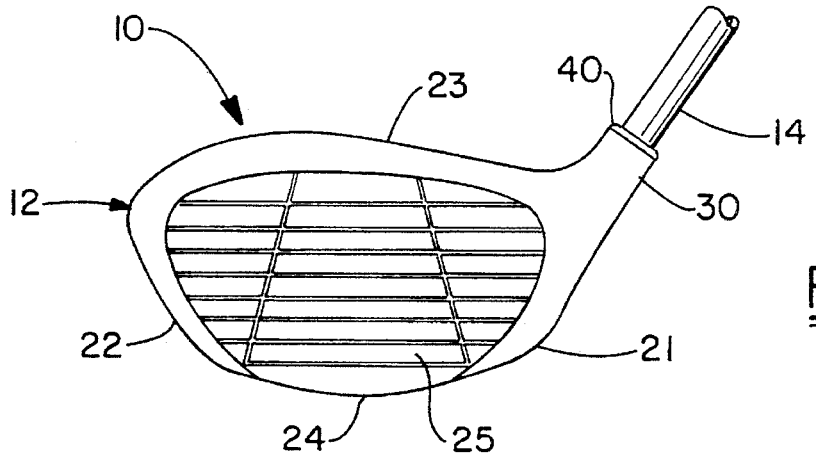
FIG. 1 is a front elevational view of a metal wood golf club with a portion of the shaft broken away.

This invention will now be described in detail with reference to specific embodiments thereof, including the best mode and preferred embodiment of the invention. Also, a specific prior art structure is illustrated for comparison purposes.

Throughout the specification, like parts are denoted by like reference numerals.

A first and preferred embodiment of this invention will now be described with reference to FIGS. 1–3 and 5–7.

Figure 2:
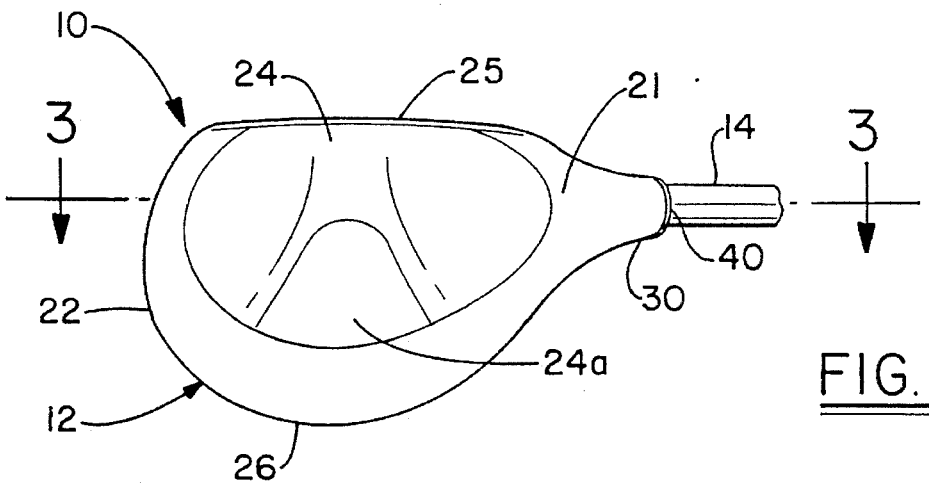
FIG. 2 is a bottom view of a metal wood with a portion of the shaft broken away.

FIGS. 1 and 2 show the front and the bottom, respectively, of a metal wood golf club identified generally as 10. Golf club 10 has a metal club head 12 and a shaft 14. Club head 12 comprises a hollow metal shell 16 which is filled with a plastic foam material 18, which may be, for example, polyurethane, rubber or a mixture of the two. Stainless steel is the most common shaft material, but other metals such as titanium, and other high strength, high modulus materials, such as graphite-boron (or other composite material) can be used. The shaft is typically tubular and the shaft material typically has high hardness in addition to high tensile strength and high modulus. Only the lower end portion of the shaft is shown.

Club head 12 comprises a heel 21, a toe 22, a top surface 23, a sole or bottom surface 24, a club face or striking surface 25, and a back 26. These parts are standard pans of a metal wood golf club head and are common both to the embodiment of the invention shown in FIGS. 1–3 and 5–7 and to the illustrated prior art shown in Fig. 4. In accordance with usual nomenclature, the heel 21 is the portion of the club head closest to the shaft 14 and the toe 22 is the portion most remote from the shaft 14. Also, as in standard prior art golf clubs, the club face 25 is nearly flat or planar (actually slightly convex) while the back (which is directly opposite the face) is rounded. The bottom surface or sole 24 of the club may have a flattened portion 24*a*. This flattened portion is intended to be level to the ground when a player is addressing a ball and again at the moment of impact when the player strikes a ball. This too is known in the art and does not form part of the invention.

A hosel 30 extends generally upwardly from the heel 21 of the club. The angle of inclination of the hosel and the angle of inclination of the back surface of the club head heel immediately therebelow are ordinarily the same.

Hosel 30 is formed as an integral part of golf club head 12. Hosel (or neck) 30 is tubular and of circular cross-section. Hosel 30 terminates at its upper end in an annular upper end surface 30*a* which surrounds an upper shaft-receiving opening 31. The upper end of hosel 30 is ordinarily only a short distance above the top surface 23 of the golf club head 12.

A cylindrical bore 32 of circular cross-section, which is coaxial with hosel 30, extends generally downwardly from the opening 31 at the upper end of hosel 30 through the hosel 30 and heel 21 of club head 12 toward the bottom face or sole 24 of the club head, but in this embodiment terminates short thereof in an end wall 34 which is inside the heel portion 21 of the club and perpendicular to the axis of the bore. The axis of bore 32 is at an acute angle to sole 24.

Figure 5:
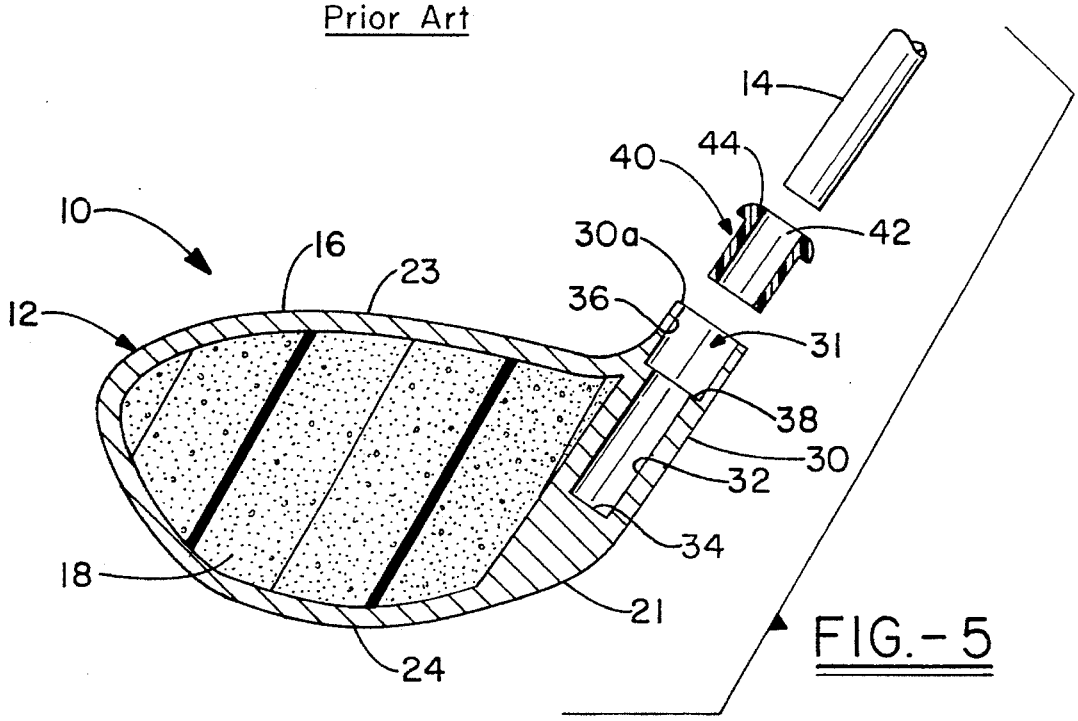
FIG. 5 is an exploded sectional view of a metal wood golf club according to this invention with a portion of the shaft broken away.
Figure 6:
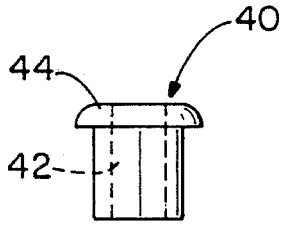
FIG. 6 is an elevational view of an insert according to the present invention.
Figure 7:
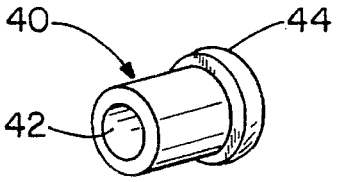
FIG. 7 is a perspective view of the insert.

A counterbore 36, provides an enlarged opening 31 at the upper end of the hosel 30. Counterbore 36 also provides a shoulder 38 in the bore 32 a short distance below the upper end of the hosel 30. Counterbore 36 ends at shoulder 36. Counterbore 36 has a right circular cylindrical configuration, is coaxial with bore 32, and is of larger diameter and shorter axial length than bore 32. Counterbore 36 is shown in FIGS. 3 and 5.

A generally cylindrical and essentially tubular insert 40, shown in FIGS. 3, 5, 6, and 7, is inserted into the upper end of bore 32, and more specifically into the counterbore 36, and seats on shoulder 38. Insert 40 has a first end and a second end, and a passageway 42 of circular cross-section which extends through the entire length of the insert 40 from the first end to the second end. The diameter of this passageway is the same as that of bore 32. An enlargement or lip 44 is formed at the upper or first end of the insert 40. The outside diameter of the insert, except at the lip, is essentially the same as that of counterbore 36, and is actually just enough smaller so that the insert can be inserted into the counterbore 36 and held in place either frictionally or with a thin layer of adhesive. The lip 44 overlies the upper end 30*a* of hosel 30. The upper surface of the lip 44 may be rounded as shown, so that the visual effect is substantially the same as that provided by an O-ring. The outer diameter of the lip 44 of the insert 40 is substantially the same as the outer diameter of the hosel. The depth of the counterbore 36 in the hosel and the axial length of the insert (excluding the lip 44) are essentially the same and are in the range of about 5 to about 10 millimeters. The diameter of bore 32 and passageway 42 are typically in the range of about 5–10 millimeters. The diameter of counterbore 36 is just slightly larger than the diameter of bore 32. The axial length of the lip 44 is equal to or less than the dimensions (5–10 mm) recited for the axial length of insert 40 (excluding the lip 44).

Insert 40 is tough and stiff, and has a Rockwell hardness which is lower than that of shaft 14. The insert 40 is preferably made of a plastic or polymer material. A particularly preferred polymer is Nylon 66, which may be compounded with fillers and other additives according to recipes known in the art.

Figure 3:
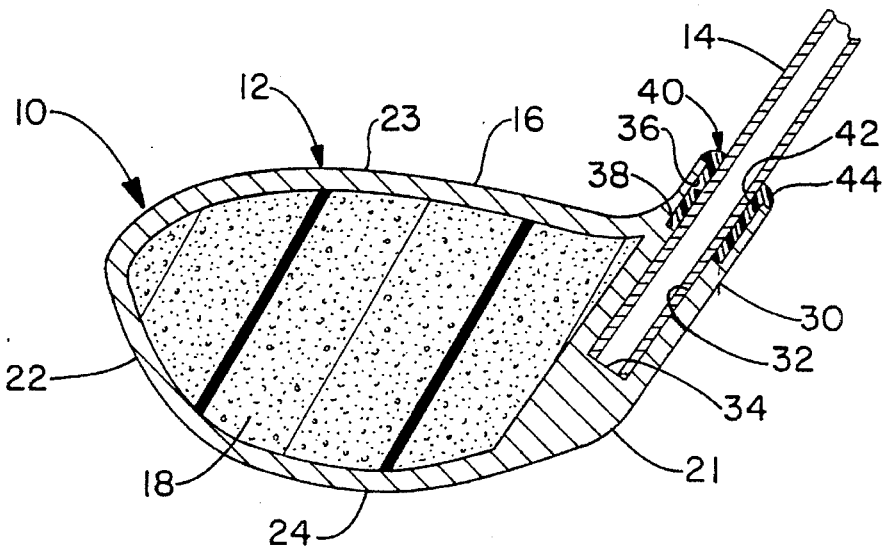
FIG. 3 is a sectional view of club head of the present invention taken across the lines 3—3 of FIG. 2.

In an assembled golf club, as best seen in FIG. 3, a lower end portion of shaft 14 extends through the central opening 42 of insert 40 and into the bore 32. The lower end of the shaft 14 is in engagement with the end wall 34 of bore 32. The insert 40 fits snugly into the hosel 30, and the shaft 14 fits snugly into the insert 40 with all components being adhesively bonded in place for final assembly. Alternatively, but not preferably, one can rely on friction fit between the insert 40 and counterbore 36 of the golf club head 12.

Insert 40 by being tough and firm and yet less hard than the shaft 14, provides a cushioning effect for the shaft. Stresses which tend to cause fracture of the shaft, instead of being concentrated at the intersection of the upper end of the hosel 30 with the shaft 14 as in prior art structures, are distributed over the entire length of the insert 40. This greatly reduces the likelihood and incidents of fracture of the shaft.

Figure 4:
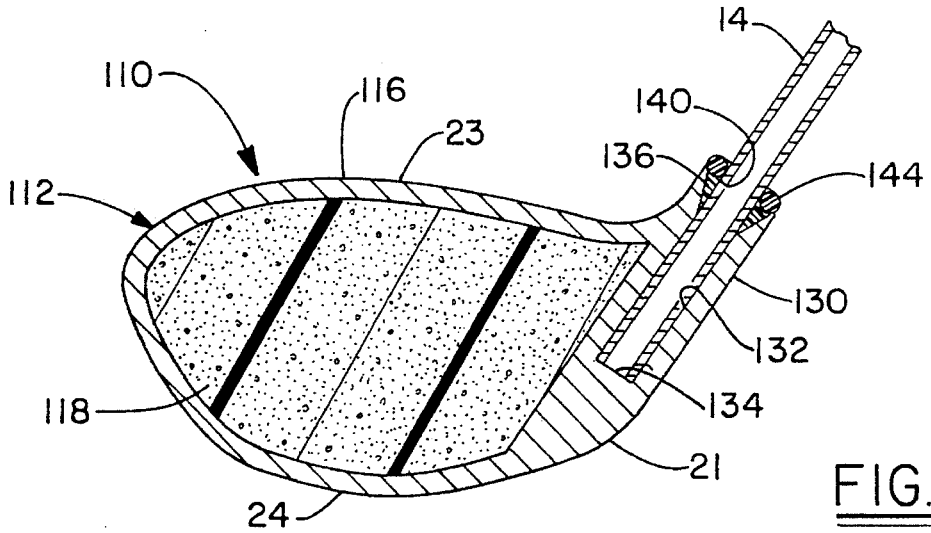
FIG.-4 Prior Art
FIG. 4 is a sectional view of a prior art club head also taken across the lines 3—3 of FIG. 2.

A prior art structure for comparison purposes is shown in FIG. 4. FIG. 4 is a vertical sectional view taken along line 3—3 of FIG. 2. The views shown in FIGS. 1 and 2 of the prior art club will look the same as those of the club of the invention which has just been described in detail. The differences will be apparent by comparing FIG. 3 with FIG. 4.

Referring now to FIG. 4, a representative club 110 according to the prior art has a metal club head 112 and a shaft 14. Club head 112 is in the form of a hollow metal shell 16 which is filled with a filling material 118. The club head 112 has a heel 21, a toe 22, a top surface 23, a bottom surface 24, and a face and a back, just as the club 10 described above has. A hosel 130 extends upwardly from top surface 23 at the heel 21 of club 110. Hosel 130 is a tubular structure of circular cross-section which terminates at its upper end in an annular upper surface which surrounds a shaft-receiving opening. Club head 112 also has a bore 132 which extends generally downwardly in the heel 21 of the club from the upper opening. Bore 132 terminates in an end wall 134 which is above the bottom face or sole 24. (In other prior art golf clubs, the bore will extend the entire height of the club head and will open to the bottom face or sole of the club.)

At the upper end of the bore 132 of prior art club head 112, just below the upper end of hosel 30, there is a frustoconical tapered countersink (or countersunk portion) 136, which provides an enlarged opening for the upper end of bore 132, which is at the upper end of hosel 130. Adhesive material 140 occupies the space between the cylindrical outer wall of shaft 14 and the frustoconical wall surface 136. An O-ring 144, which is in sealing engagement with the shaft 14 and with the upper end of hosel 130, holds the adhesive material 140 in place.

As discussed above, the adhesive material 140 may eventually break loose, at which point the O-ring 144 may roll up and down along the shaft 14.

The adhesive 140 does not have as much structural strength or toughness as the insert 40 of this invention, and so is less effective for cushioning the shaft 14 from stress which may cause fractures. Also, because the adhesive 140 is softer than the insert of this invention, flexure of the shaft during swinging of the golf club will often cause the adhesive to break loose in time. Once the adhesive has broken loose, the shaft 14 is essentially unprotected from stresses causing fractures at the intersection of the shaft with the upper end of hosel 30.

The external configurations of club 10 according to this invention and prior art club 110 may be the same. Both clubs may have the same size and shape. The lip 44 of insert 40 may be rounded so that it has the same external appearance as 0-ring 140 in the prior art club. The counterbore 36 and the remainder of insert 40 in a club of the present invention, as well as the countersunk portion 136 and adhesive material 140 therein in prior art club 110, are hidden from view.

Figure 8:
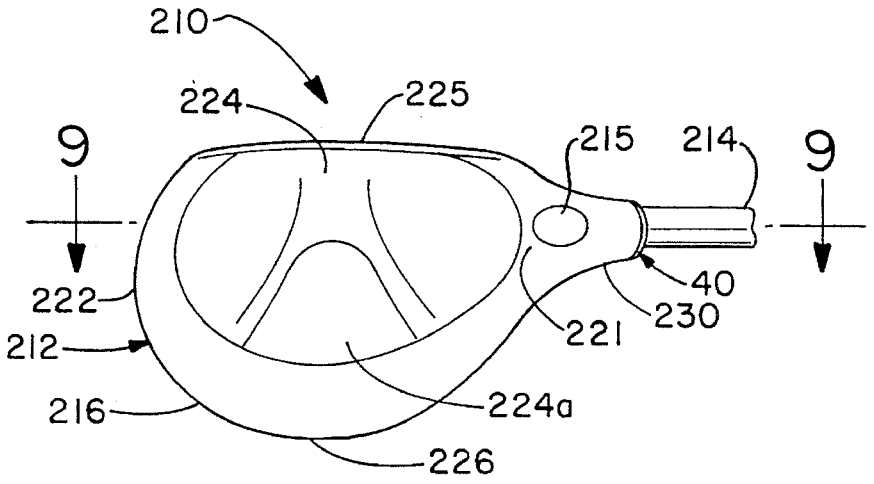
FIG. 8 is a bottom view of a metal wood according to a second embodiment of the invention, with a portion of the shaft broken away.
Figure 9:
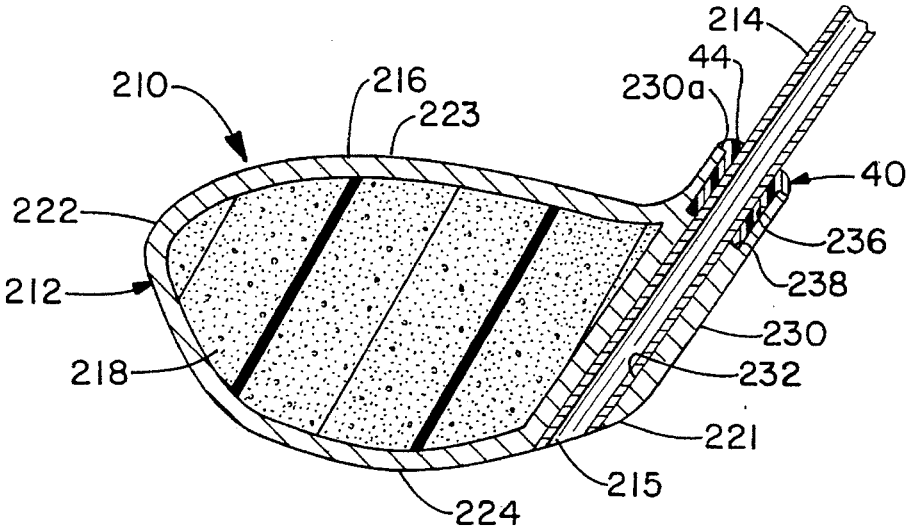
FIG. 9 is a vertical sectional view of a metal wood taken along line 9—9 of Fig. 8, with a portion of the shaft broken away.

FIGS. 8 and 9 illustrate a second embodiment of the present invention. In this embodiment, the lower end of the shaft is flush with the sole of the club, and the heel portion of the club is provided with a shaft-receiving bore that extends the entire distance from the upper portion of the hosel to the sole of the club.

Referring now to FIGS. 8 and 9, a golf club 210 comprises a club head 212 and a shaft 214, which is metallic and typically stainless steel. The lower end 215 of the shaft 214 is flush with the sole of the club head 212 and is essentially planar, disposed at an acute angle to the axis of shaft 214, and accordingly is elliptical in shape.

As best seen in FIG. 9, the head 212, as is well-known in the art, comprises a hollow metal shell 216 which is filled with a plastic foam filling 218.

The club head 212, or more precisely the metal shell of the club head, comprises a heel 221, a toe 222, a top surface 223, a sole or bottom surface 224, a face 225, and a back 226.

Extending upwardly from the heel portion 221 of the club 212 and integral therewith is a hosel 230. Hosel 230 is cylindrical in shape, essentially tubular, and has an annular upper surface **230*a*** which surrounds a circular shaft-receiving opening.

A bore 232 of circular cross-section extends generally downwardly through the hosel 230 and the heel 221 of club head 212 from the upper surface **230*a* of the hosel to the sole 224 of the club head. This bore receives shaft 214. Bore 232 has an upper end at the upper surface 230*a* of hosel 230 and a lower end at the sole 224 of club head 212. Both ends of the bore are open. Bore 232 is coaxial with hosel 230**.

A counterbore 236, which is coaxial with bore 232, is of slightly greater diameter than bore 232 and appreciably shorter in axial length. The diameters of bore 232 and counterbore 236, and the axial length of counterbore 236, may be the same as those of the counterpart bore 32 and counterbore 36 in the first embodiment, which is described with reference to FIGS. 1–3 and 5–7. The lower end of counterbore 236 forms a shoulder 238, which is adapted to receive and position a lower end of insert 40.

Insert 40 is inserted into the counterbore 236. The lower end of insert 40 seats on shoulder 238. A lip 44, which is formed on the upper end of insert 40, and overlies the upper surface 231 of hosel 230. Insert 40 used in this embodiment is preferably identical to insert 40 used in the first embodiment, and so the same reference numerals have been used.

The external appearance of a club 210 according to the second embodiment of the invention is the same as that of a club 10 according to the first embodiment, except that the lower end of the club shaft 214 is visible and the sole 224 of a club head 212 has an elliptical opening 215 for the lower end of the shaft.

Figure 10:
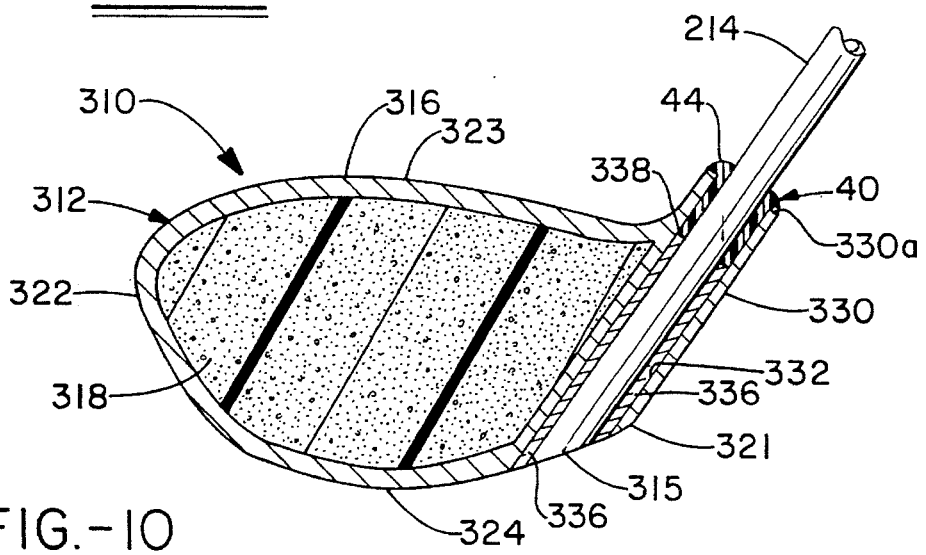
FIG. 10 is a vertical sectional view of a club according to a third embodiment of the invention with a portion of the shaft broken away.

A third embodiment of this invention is shown in FIG. 10. A shoulder for seating insert 40 is provided in this embodiment by means of a tubular sleeve which is inserted into a bore, rather than by means of a counterbore as in the first two embodiments.

The external appearance of a club according to the third embodiment of this invention is the same as the external appearance of a club according to the second embodiment.

Referring now to FIG. 10, a metal wood golf club 310 according to the third embodiment of the invention comprises a club head 312 and a shaft 214. The shaft 214 illustrated herein is identical to the shaft 214 in the second embodiment of the invention (FIGS. 8 and 9) and so the same reference numeral has been used. Club head 312 comprises a hollow metal shell 316 which is filled with a plastic foam filling 318.

Club head 312 has a heel 321, a toe 322, a top surface 323, a face, and a back (not shown) which are similar to their counterparts in the embodiment of FIGS. 1–3 and 5–7. Club head 312 also has a sole or bottom surface 324 which is similar in appearance to the sole or bottom surface 224 of club 210 shown in FIGS. 8 and 9. Bottom surface 324 of club head 312 has an elliptical opening 315 for the lower end of shaft 214.

Club 312 further comprises a tubular hosel 330 which extends upwardly from the top surface 323 of the club at the heel 321. Hosel 330 has an annular upper end **330*a*** which surrounds a shaft-receiving opening.

Bore 332 extends generally downwardly through the hosel 330 and the heel 321 of club 310 from the opening at the upper end of the hosel 330 to the sole 324 of the club. Bore 332 is of slightly greater diameter than the bores in the previous embodiments. The diameter of bore 332 may be from about 8 millimeters to about 12 millimeters, with 10 millimeters being typical. The diameter of bore 332 in this embodiment is about the same as the diameter of the counterbore (e.g., 36 and 236) in the previous embodiments. Bore 332 is open at both ends, having an open upper end at the upper end of hosel 330 and an open lower end at sole 324.

A thin, cylindrical tubular sleeve 336, which is preferably metallic, is inserted into bore 332. This sleeve 336 has an outside wall surface which abuts the cylindrical wall of bore 332, and an inside wall surface which is of about the same diameter as the bores in the first two embodiments, so as to receive the lower portion of shaft 214. Sleeve 336 has an upper or first end which forms a shoulder 338 below the upper end of bore 332 and a lower or second end which is flush with the sole 224 of club 312. Shoulder 338 serves to position an insert 40. The distance from shoulder 338 to the upper end of the hosel 330 (at annular surface **330*a*) is typically about 5 to about 10 millimeters, i.e., essentially the same distance as the distance from the shoulder 36 or 236** to the upper end of the hosel in previous embodiments.

An insert 40 is inserted into the upper portion of bore 332, so that the lip 44 overlies the annular upper surface of hosel 330 and the lower or second end of the insert is in abutting relationship with shoulder 338. The upper portion of bore 332 serves the same function as the counterbore in the previous embodiments, and is of about the same diameter. A club shaft 214 is inserted through the central opening 42 of the insert and into the tubular sleeve 336. The lower end of shaft 214 is flush with the sole 224 of club head 312. The sleeve 336, insert 40, and shaft 214 may be secured to the club head 312 by means of an adhesive.

Various modifications can be made by those skilled in the art. For example, a shoulder may be formed by an insert sleeve similar to sleeve 336 in a club head having a blind bore such as bore 32 in FIGS. 1–3 and 5–7; an open-ended bore has been used in FIG. 10 simply for purposes of illustration. While a hosel is shown in all embodiments herein, it will be apparent that the present invention is also applicable to hosel-less golf clubs such as that shown in U.S. Pat. No. 5,042,806. When there is no hosel, an upper shaft-receiving opening will be formed in the top surface (e.g., 23, 223, or 323) of the golf club head rather than at the upper end of the hosel.

This invention has been illustrated with particular reference to metal woods; however, the invention may also be applied to wooden woods and to golf club irons, although metal woods represent the preferred embodiment because of the greater incidence of shaft breakage.

While this invention has been described in detail with reference to specific embodiments in compliance with statute, it shall be understood that various other modifications in addition to those mentioned can be made by persons skilled in the art without departing from the scope and spirit of this invention.

What is claimed is:

1. A golf club head with an upper opening for insertion of a shaft, and a bore having an open upper end and extending generally downwardly from said open upper end, wherein:

said bore includes a slightly larger diameter counter bore to provide a shoulder between 5 mm to 10 mm below said upper end, and wherein the bore is between 5 mm and 10 mm in diameter;

said club further comprises an essentially cylindrical, tubular insert tightly fitted within said bore, said insert having an enlarged upper portion forming a lip seating on said upper end of said bore, said enlarged upper portion having a short axial length extending no more than 10 mm above said upper end of said bore, said insert having a first end and a second end, said second end seating on said shoulder of said bore, said insert being made of a tough and stiff polymer with a Rockwell hardness lower than the shaft so as to provide a cushion to said shaft.

2. A golf club head as claimed in claim 1 wherein said club head has a counterbore which forms said shoulder.

3. A golf club head as claimed in claim 1 wherein the bore extends substantially into the club head and terminates in an end wall.

4. A golf club head as claimed in claim 1 wherein the bore extends substantially entirely through the club head.

5. A gulf club head as claimed in claim 1, said golf club head being of the metal wood type and comprising a hollow metal shell and a filling therein.

6. A golf club as claimed in claim 1 wherein the insert is plastic.

7. A golf club head as claimed in claim 6, wherein said insert is made substantially from nylon.

8. A golf club head as claimed in claim 1 wherein the club head has a hosel through which a shaft is adapted to be inserted.

9. A golf club head as claimed in claim 8 wherein said club head has a heel and a toe and said hosel extends upwardly from the heel of the club.

10. A golf club as claimed in claim 1 wherein the insert fits snugly into the bore and the shaft fits snugly in the insert.

11. A golf club as claimed in claim 1 wherein the club head, the insert, and the shaft are adhesively secured to each other in a fixed position.

12. A golf club as claimed in claim 1, said golf club being of the metal wood type wherein said club head comprises a hollow metal shell and a filling contained therein.

13. A golf club head as claimed in claim 1, wherein the axial length of said insert, exclusive of said enlarged upper portion, is of approximately the length as the diameter of the bore.

14. A golf club head as claimed in claim 13, wherein the distance from said upper end of said bore to said shoulder is substantially equal to the axial length of said insert exclusive of the enlarged upper portion thereof.

15. A golf club head with an upper opening for insertion of a shaft, and a bore having an open upper end and extending generally downwardly from said open upper end, wherein:

said bore includes a slightly larger diameter counter bore to provide a shoulder between 5 mm to 10 mm below said upper end, and wherein the bore is between 5 mm and 10 mm in diameter;

said club further comprises an essentially cylindrical, tubular insert tightly fitted within said bore, said insert having an enlarged upper portion forming a lip seating on said upper end of said bore, said enlarged upper portion having a short axial length extending above said upper end of said bore which is equal to or less than the axial length of said counterbore, said insert having a first end and a second end, said second end seating on said shoulder of said bore, said insert being made of a tough and stiff polymer with a Rockwell hardness lower than the shaft so as to provide a cushion to said shaft.

16. A golf club head having an upper opening for insertion of a shaft, and a bore having an open upper end and extending generally downwardly from said open upper end, and said club further comprising:

a sleeve inserted into said bore forming a shoulder below said upper end of said bore;

an essentially cylindrical, tubular insert fitted into said bore, said insert having a first end and a second end, said first end having an enlarged upper portion forming a lip seating on said upper end of said bore, said enlarged upper portion having a short axial length extending no more than 10 mm above said upper end of said bore, and said second end extending into said bore, said insert being made from a tough and stiff polymer with a Rockwell hardness lower than the shaft so as to provide a cushion to said shaft.

17. A golf club head as claimed in claim 16, wherein said insert further has a cylindrical lower portion having a side wall engagement with said bore and fitting snugly into the bore, and wherein further said shaft fits snugly into said insert.

18. A golf club head as claimed in claim 16, wherein said sleeve is made from metal.

19. A golf club head as claimed in claim 16, wherein said second end of said insert is seated on the should of said bore formed by said sleeve.

* * * * *